US010155293B2

(12) United States Patent
Shimamura et al.

(10) Patent No.: US 10,155,293 B2
(45) Date of Patent: Dec. 18, 2018

(54) DIAMOND SURFACE POLISHING METHOD AND APPARATUS FOR IMPLEMENTING SAME

(71) Applicant: TOYO SEIKAN GROUP HOLDINGS, LTD., Tokyo (JP)

(72) Inventors: Masahiro Shimamura, Yokohama (JP); Kenichi Takao, Yokohama (JP); Ryozo Shiroishi, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 0 days.

(21) Appl. No.: 15/696,491

(22) Filed: Sep. 6, 2017

(65) Prior Publication Data

US 2018/0021912 A1 Jan. 25, 2018

Related U.S. Application Data

(63) Continuation of application No. PCT/JP2016/056528, filed on Mar. 3, 2016.

(30) Foreign Application Priority Data

Mar. 9, 2015 (JP) ..... 2015-046024

(51) Int. Cl.
*B24B 49/00* (2012.01)
*B24B 9/16* (2006.01)
*B24B 21/00* (2006.01)

(52) U.S. Cl.
CPC ..... *B24B 9/16* (2013.01); *B24B 21/00* (2013.01)

(58) Field of Classification Search
CPC .. B24B 49/00; B24B 9/16; B24B 1/00; B24B 21/00
(Continued)

(56) References Cited

U.S. PATENT DOCUMENTS 2,292,550 A * 8/1942 Simons ..... B28D 5/021 125/30.02
2,325,713 A * 8/1943 Simons ..... B24B 5/485 125/30.02
(Continued)

FOREIGN PATENT DOCUMENTS

DE 251167 C 9/1912
JP 52-2517 B2 1/1977
(Continued)

OTHER PUBLICATIONS

International Search Report dated Apr. 19, 2016, issued in counterpart application No. PCT/JP2016/056528. (2 pages).

*Primary Examiner* — Robert Rose
(74) *Attorney, Agent, or Firm* — Westerman, Hattori, Daniels & Adrian, LLP

(57) ABSTRACT

The diamond surface polishing method according to the present invention involves polishing a polished object, the surface of which is made of diamond, by rubbing a polishing member having an elongated shape such as a linear or belt-like shape and containing at least a metal or a metal oxide against the diamond surface, wherein a pressing force of the polishing member is controlled in accordance with material properties of the polishing member and/or a shape of the polished object and a diamond crystal size in a rubbing section so that contact surface pressure in a machining area becomes uniform.

19 Claims, 6 Drawing Sheets

(58) Field of Classification Search
USPC ..... 451/28, 5, 41, 8–10, 245, 57, 58, 591; 125/21, 16.02
See application file for complete search history.

(56) References Cited

U.S. PATENT DOCUMENTS

| | | | | |
|---|---|---|---|---|
| 5,725,413 | A * | 3/1998 | Malshe | B24B 1/00 451/289 |
| 2010/0213175 | A1* | 8/2010 | Peng | B24B 9/16 216/96 |
| 2010/0304644 | A1* | 12/2010 | Gogolewski | B24B 7/22 451/36 |
| 2013/0252515 | A1* | 9/2013 | Shiroishi | B24B 1/00 451/41 |

FOREIGN PATENT DOCUMENTS

| | | | |
|---|---|---|---|
| JP | 2005-125440 | A | 5/2005 |
| JP | 2007-237344 | A | 9/2007 |
| JP | 2011-177883 | A | 9/2011 |
| JP | 2015-100861 | A | 6/2015 |

* cited by examiner

| DIAMOND CRYSTAL | LARGE CRYSTAL | SMALL CRYSTAL |
|---|---|---|
| DIAMOND SURFACE PHOTOGRAPH (BEFORE POLISHING) | | |
| POLISHING PERFORMANCE | HARD | EASY |

DIAMOND SURFACE POLISHING METHOD AND APPARATUS FOR IMPLEMENTING SAME

TECHNICAL FIELD

The present invention relates to a method for polishing the surface of a diamond and of a diamond film, and to an apparatus for implementing the polishing method.

BACKGROUND ART

Properties of a diamond, which is a carbon crystal, not only include extreme hardness and superior abrasion resistance but also include superior slidability and thermal conductivity as well as a high refractive index. Due to having such properties, for example, diamonds are used as cutting tools such as a bite, an end mill, and a file, plastic working dies such as a punch and a die, sliding members such as a valve lifter and a bearing, heat dissipating members such as a heat sink, electronic substrates, and optical parts such as a lens and a window. Such diamond products are machined in accordance with their applications and are generally required to have a polished smooth surface. Applications of polished diamonds include press dies such as a die and a punch, sliding portions in a bearing, automotive parts and the like, cutting tools such as a bite and an end mill, a heat sink or an electronic substrate of electronic devices, and optical parts.

While mechanical polishing methods which also use a diamond as polishing means in the form of abrasive grains or a whetstone were adopted for polishing a diamond surface in the past, since polishing using these methods are not only time-consuming but also cause simultaneous cutting, there were problems of a short tool life and an inadequacy with respect to polishing a diamond surface that is a three-dimensional surface with irregularities instead of a flat surface.

While a polishing method disclosed in Patent Literature 1 adopts a preheating method by laser irradiation and performs polishing by causing a chemical reaction between a metal constituting a polishing member and carbon on a diamond surface, an object of this invention is to provide a diamond surface polishing method which ensures that a polishing member has a long service life, which enables the polishing member to be readily controlled, which produces a surface with high smoothness, and which is readily applicable even to polishing three-dimensional surfaces with irregularities and to provide a diamond surface polishing method which enables polishing to be performed using a polishing member formed by an inexpensive simple metal instead of using an expensive material obtained by a special production method such as an intermetallic compound. To this end, as shown in FIG. 10, this invention provides a diamond surface polishing method in which a polishing member 3 or a diamond surface 1*a* is heated by a laser beam 2*a* or the like prior to polishing by the polishing member, which has a linear or belt-like shape and at least a surface of which is made of a metal easily reactive with carbon or a carburizing metal is used as the polishing member 3. Polishing is performed by moving a polished object 1 by applying pressure to a diamond surface via a polishing member supporting tool 4, which is a pulley, a roller, or the like, while winding the polishing member 3 around the polishing member supporting tool 4 and continuously or intermittently paying out the polishing member.

In addition, Patent Literature 2 is a description of an invention titled "Diamond surface polishing method" previously filed as a patent application by the present applicants, the contents of which relate to a method for polishing a diamond while removing abrasive powder remaining on a surface of the diamond. Patent Literature 2 describes that this invention is a diamond surface polishing method which uses a metallic polishing member and heats the polishing member and/or a diamond surface and which polishes while removing, by rubbing, abrasive powder derived from the polishing member remaining on the diamond surface, and that preferred specific examples include: (1) when removing the abrasive powder, using at least one means selected from a group consisting of a finishing tool, a dressing tool, a shot blast, fluidic injection, electrostatic force, magnetic force, and adhesive force; and (2) when removing the abrasive powder, further using air blowing or vacuuming. According to this diamond surface polishing method, by rubbing a diamond surface being polished with a finishing tool or the like, metal powder (abrasive powder) derived from the polishing member adhering to irregularities of the diamond surface can be effectively removed and a problem of adhesion created by subjecting the abrasive powder to heat and pressure can be solved.

When polishing a diamond surface using a conventional polishing method, even if polishing is performed in a state where a polishing member is brought into contact with a surface of a polished object at a constant pressing force, there is a problem in that non-uniform polishing occurs when the contour shape of the polished object is non-uniform, such as a shape with irregularities, instead of a uniform flat shape.

CITATION LIST

Patent Literature

Patent Literature 1: "Diamond Surface Polishing Method", Japanese Patent Application Laid-open No. 2011-177883, published on Sep. 15, 2011

Patent Literature 2: "Diamond Surface Polishing Method", Japanese Patent Application No. 2013-241369 (Specification), filed on Nov. 21, 2013

SUMMARY OF INVENTION

Technical Problem

As a result of a thorough examination of this phenomenon carried out by the present inventors, it was found that the phenomenon is caused when a state of contact of a polished object with a polishing member changes when the polished object has a shape with irregularities instead of a uniform flat shape, in which case a difference in surface pressure of a rubbing section is created even when the polishing member is brought into contact with a constant pressing force and, in turn, a difference in a polished amount is created.

In addition, it was also discovered that, when a crystal size of diamonds on a surface of the polished object differs, a difference in a polished amount is created even when polishing is performed by bringing the polishing member into contact with the surface of the polished object at a constant pressing force.

An object of the present invention is to solve the problem described above or, in other words, to solve the problem of occurrences of non-uniform polishing or substrate exposure in a method for polishing a diamond surface of a polished object with a polishing member containing a metal or a metal oxide, and to provide a polishing method which achieves uniform polishing without being affected by a shape of the polished object.

Solution to Problem

A diamond surface polishing method according to the present invention is a diamond surface polishing method for polishing a polished object, the surface of which is made of diamond, by rubbing a polishing member having an elongated shape such as a linear or belt-like shape and containing at least a metal or a metal oxide against the diamond surface, wherein, while a polishing surface of the polishing member is continuously or intermittently polished, a pressing force of the polishing member is controlled in accordance with material properties of the polishing member and/or a shape of the polished object in a rubbing section so that contact surface pressure in a machining area becomes uniform.

In addition, in the diamond surface polishing method according to the present invention, the pressing force of the polishing member is corrected in accordance with a crystal size of a surface diamond.

A diamond surface polishing apparatus according to the present invention is a polishing apparatus including: means for holding a polished object; a polishing member having an elongated shape such as a linear or belt-like shape and containing at least a metal or a metal oxide; pressing means for pressing the polishing member toward a machining surface of the polished object; and means for causing the polishing member and the polished object to relatively move and rub against each other, the polishing apparatus further including: means for inputting and storing a shape or coordinate information of the polished object; and means for inputting or computing a pressing force to the shape of the polished object, wherein the pressing means is controlled in accordance with a prescribed pressing force that has been computed.

In addition, the means for inputting or computing a pressing force inputs or computes the pressing force so that the contact surface pressure in the machining area becomes uniform.

Furthermore, means is provided which continuously or intermittently pays out the polishing member.

In addition, means is provided which rotates the means for holding the polished object.

Furthermore, the diamond surface polishing apparatus according to the present invention includes means for inputting a crystal size of a diamond, and correctively computes the prescribed pressing force in accordance with the crystal size that has been input.

Advantageous Effects of Invention

With the diamond surface polishing method according to the present invention, since the pressing force of the polishing member is controlled in accordance with material properties of the polishing member and/or a shape of the polished object in the rubbing section so that contact surface pressure in a machining area becomes uniform, polishing that is free from non-uniform polishing and occurrences such as substrate exposure can be achieved without being affected by the shape of the polished object.

In addition, in the diamond surface polishing method according to the present invention, even when there is a distribution of crystal sizes in the surface diamond, since the pressing force of the polishing member is corrected in accordance with the distribution information, non-uniform polishing which occurs due to a difference in a polishing amount based on the diamond crystal size can be effectively compensated.

With the diamond surface polishing apparatus according to the present invention, since the polishing apparatus includes means for inputting and storing a shape or coordinate information of the polished object and means for computing a pressing force in accordance with a shape of the polished object so that the contact surface pressure in the machining area becomes uniform, an appropriate pressing force based on input or stored information can be applied to the polishing member, and a polishing process that is free from non-uniform polishing and occurrences such as substrate exposure can be provided without being affected by the shape of the polished object.

In addition, even with an apparatus in which a material and a shape of the polishing member are not specified but are selective, when the inputting and storing means includes a function of additionally inputting and storing information on the material and the shape of the polishing member, a function of computing an appropriate pressing force in accordance with a difference in a polishing amount due to a combination of the polishing member and the polished object can be provided and, consequently, an appropriate polishing process can be achieved.

Furthermore, with the diamond surface polishing apparatus according to the present invention in which the inputting and storing means includes, in addition to inputting a crystal size of a diamond, storing a polishing amount corresponding to a combination of a diamond particle crystal size and a polishing member as table information, and the computing means includes a function of referring to the table information and correctively computing the prescribed pressing force in accordance with a difference in a polishing amount based on a diamond crystal size, since a correction corresponding to a difference in a polishing amount based on a diamond crystal size can be made, an appropriate polishing process can also be achieved when machining a polished object with a distribution in diamond crystal sizes.

REFERENCE SIGNS LIST

Figure 1:
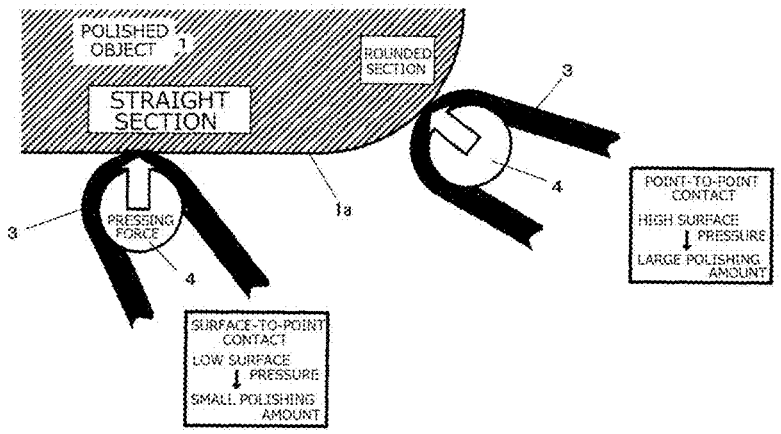
FIG. 1 is a diagram for explaining that a difference in a polishing amount is created depending on a shape of a polished object.

1 Polished object
1*a* Machined surface (diamond surface)
2 Laser irradiating means
2*a* Laser beam
3 Polishing member
4 Polishing member supporting tool
5 Diamond crystal
11 Input means
12 Storage unit
13 Computing/control unit
14 Polishing head pressing means
15 Polishing member heating means
16 Polishing head driving means
17 Polished object heating means
18 Polished object holding means
19 Motor

DESCRIPTION OF EMBODIMENT

Figure 2:
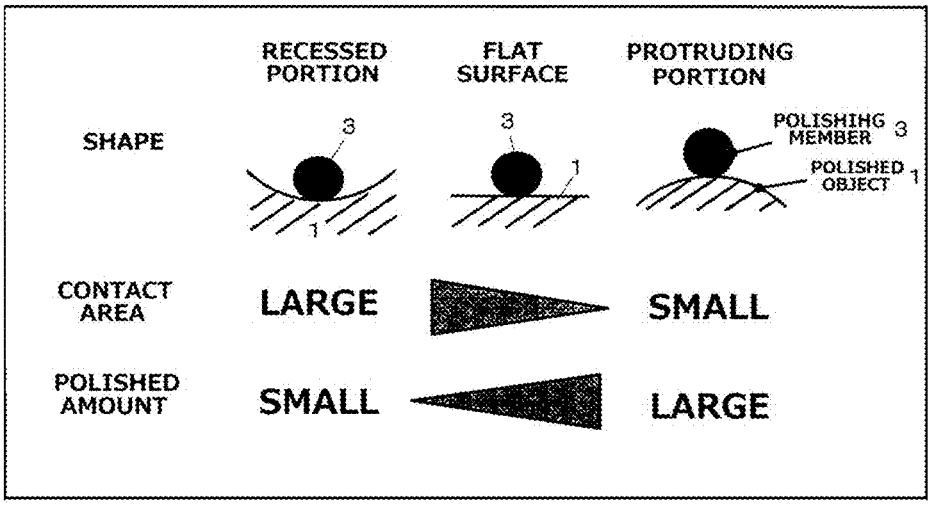
FIG. 2 is a diagram comprehensively showing a relationship between a shape of a polished object and a polishing amount.

First, discovery of the problem addressed by the present invention will be described. As shown in FIG. 1, in polishing in a mode in which polishing is performed by pressing a polishing member 3 with an elongated shape against a surface 1*a* of a polished object via a polishing member supporting tool 4 while continuously or intermittently polishing a surface of the polishing member by winding the polishing member 3 around the polishing member supporting tool 4, when a shape of a tip of the polishing member 3 that is a metal wire is a circle and a shape of the polished object 1 includes a straight section and a rounded section, a phenomenon is confirmed in which the rounded section experiences a larger polishing amount than the straight section when a polishing process is performed in a state where the polishing member 3 is brought into contact with the polished object 1 by a uniform pressing force. A thorough examination of a cause of the phenomenon led to a finding that a difference in a contact state with the polishing member occurs between a flat-shaped portion and a protruding portion even when a same pressing force is applied or, in other words, a wider contact area in a flat-shaped area and a smaller contact area in a protruding portion creates a difference in pressure per unit area, which in turn creates a difference in a polishing amount. When a recessed portion exists in the shape of the polished object, since the recessed area has a wider contact area with the polishing member than the flat-shaped area, the polishing amount further decreases. As shown in FIG. 2, this difference in polishing amounts due to a difference in surface pressure translates to a recessed portion, a flat surface, and a protruding portion having contact areas that are respectively large, medium, and small and surface pressures that are in a reverse relationship thereof, and locations with high surface pressure are to be polished at a higher rate and a phenomenon of substrate exposure is more likely to occur. In other words, when both portions are polished with a same pressing force, non-uniform polishing may occur and, when excessive surface pressure is applied, surface diamonds may be scraped and a substrate may become exposed.

In addition, with a polished object with a difference in a crystal size of a surface diamond depending on location, non-uniform polishing occurs when a polishing process is performed under same conditions and the problem of substrate exposure may arise. As demonstrated by the photographs shown in FIG. 3, it has been confirmed that diamond crystals include large crystals and small crystals and that the smaller the crystal size, the larger the polishing amount.

Figures 3, 4:
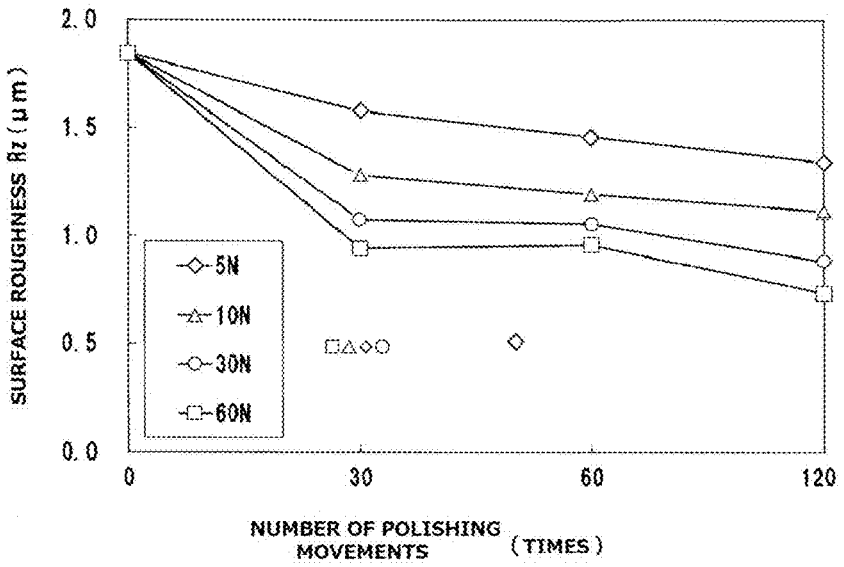
FIG. 3 is a diagram showing a crystal size of a diamond that is a polished object, a photograph thereof, and a polishing amount thereof.
FIG. 4 is a graph showing how a polishing amount of a diamond differs in accordance with a pressing force.

Next, a polishing state in a case where a surface of a polished object with a same diamond crystal size is polished while varying a pressing force with respect to the surface of the polished object will be examined. A test was performed involving heating the surface of the polished object by irradiating a laser (output 41 W) and, using a metal polishing member, rubbing the polished object at 100 mm/s with a prescribed pressing force in a state where a tip of the polishing member is heated to a temperature of 200° C. FIG. 4 is a graph display of converted data from surface roughness when the number of rubbing movements reached 30 times, 60 times, and 120 times while respectively setting the pressing force to 5 N, 10 N, 30 N, and 60 N. As is apparent from the result, it can be confirmed that the larger the pressing force, the larger the polishing amount and that the pressing force significantly affects a polishing process.

Figure 5:
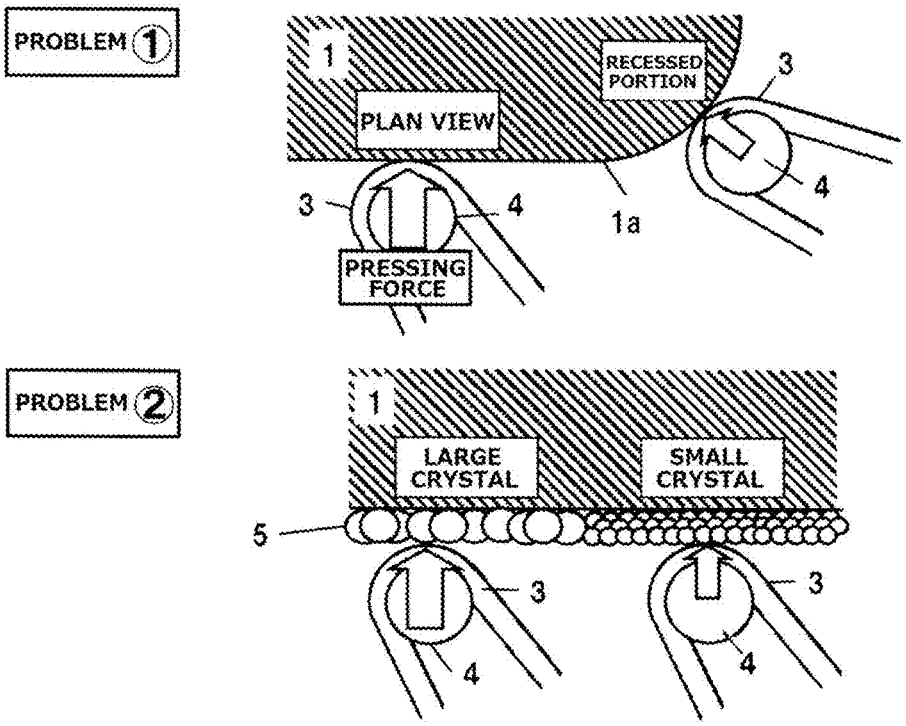
FIG. 5 is a diagram explaining a method according to the present invention for solving non-uniform polishing.

Next, a fundamental technical idea of the polishing processing method according to the present invention will be described. Regarding the resolution of the problem of non-uniform polishing due to a difference in the shape of the polished object (problem 1), based on the finding described earlier in that, in accordance with the surface of a polished object having a recessed portion, a flat surface, and a protruding portion, contact areas with the polishing member are respectively large, medium, and small while surface pressures are in a reverse relationship thereof, and locations with high surface pressure are to be polished at a higher rate and a phenomenon of substrate exposure is more likely to occur, the present invention is configured to control a pressing force of the polishing member so that surface pressure of a machining area becomes uniform. In other words, in accordance with a recessed portion, a flat surface, and a protruding portion, pressing force is controlled to be small, medium, and large. An upper half of FIG. 5 schematically shows that pressing force is increased in a flat portion while pressing force is reduced in a protruding portion.

Regarding the resolution of the problem that a polishing amount varies in accordance with a diamond crystal size on the surface of a polished object (problem 2), in consideration of the fact that the variation is caused by a property that the smaller the crystal size, the more readily the polished object is polished as described earlier, the present invention adopts a method for controlling the pressing force of the polishing member in accordance with the diamond crystal size. In other words, the pressing force of the polishing member is increased in portions with a large crystal size while the pressing force of the polishing member is reduced in portions with a small crystal size. A lower half of FIG. 5 schematically shows that the pressing force is increased in an area with a large crystal size (large grain diameter) while the pressing force is reduced in an area with a small crystal size (small grain diameter).

Figure 6:
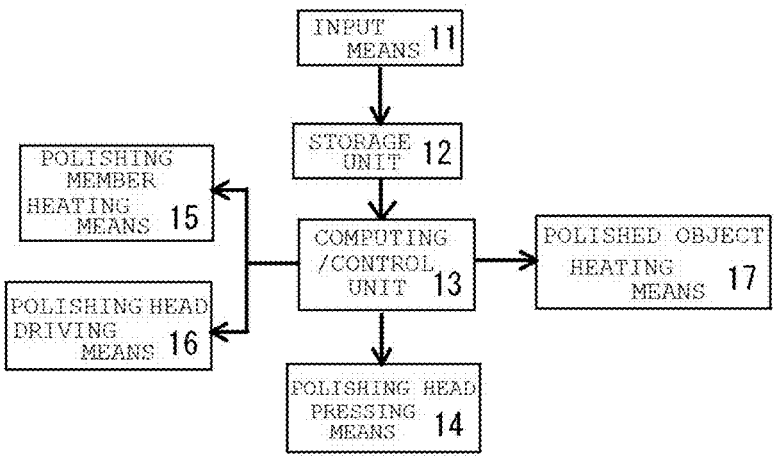
FIG. 6 is a block diagram showing a basic configuration of a control unit of a polishing apparatus according to the present invention.

A basic configuration of a control system in a polishing apparatus according to the present invention which is free of non-uniform polishing and substrate exposure is shown as a block diagram in FIG. 6, and operation functions will be described with reference thereto. Reference numeral 11 denotes input means such as keyboard for inputting basic information and setting information and transmitting operation commands, reference numeral 12 denotes a storage unit for storing a difference in polishing amounts corresponding to combinations of a polishing member and a polished object, correction amounts of a pressing force due to a diamond crystal size, and the like, and reference numeral 13 denotes a computing/control unit for reading correspondence information based on set conditions from the storage unit 12 and computing and outputting an appropriate control amount to the respective units of the present apparatus including polishing head pressing means 14, polishing member heating means 15, polishing head driving means 16, and polished object heating means 17. Since a chemical reaction with a diamond and a mechanical frictional force of a polishing member differs depending on material properties of the polishing member, and a polishing amount also varies depending on a shape of the polishing member as well as on a combination with a shape of the polished object, a database of polishing information in accordance with various selection conditions is to be created and accumulated in the storage unit 12. In addition, since a polishing amount also varies depending on a diamond crystal size, a database is also created for a correction amount of the polishing amount as table information and similarly accumulated in the storage unit 12. Furthermore, the storage unit 12 is desirably configured so that data can be input to the storage unit 12 from an external memory such as a USB memory. The accumulated information functions as a lookup table corresponding to set conditions, and necessary information is read from the storage unit 12 to be transmitted to the computing/control unit 13. In accordance with set conditions, the computing/control unit 13 computes an appropriate control amount of the respective units of the present apparatus including the polishing head pressing means 14, the polishing member heating means 15, the polishing head driving means 16, and the polished object heating means 17, and outputs the appropriate control amount to each unit.

Figure 7:
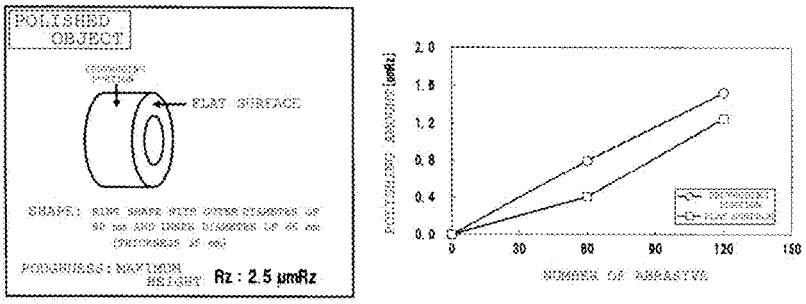
FIG. 7 is a diagram showing data of an actual measurement of a polishing amount when polishing a first polished object having a protruding portion and a flat portion.

FIG. 7 is a diagram showing data of an actual measurement of a polishing amount when polishing a first polished object having a protruding portion and a flat portion. Specifications of the first polished object are as shown on a left side of the diagram, in which the first polished object has a ring shape with an outer diameter of 90 mm, an inner diameter of 66 mm, and a thickness of 35 mm and a surface roughness with a maximum height Rz of 2.5 μmRz, and is created by coating a superalloy substrate with a diamond using a hot-filament CVD method. With the first polished object as a test sample, using a fiber laser under irradiation conditions of an output value of 30 W and a spot diameter of 0.5 mm, polishing was performed by adjusting a temperature of a polishing member being a wire made of tantalum (diameter 1 mm) to 200° C. and setting a circumferential velocity of the ring-like polished object to 300 mm/s, a wire feeding velocity to 0.36 mm/s, and a feeding pitch of a polishing head to 0.01 mm. Setting the pressing force of the polishing member to 30 N, an abrasive operation was repeated with respect to an outer circumferential surface (protruding surface portion) and a flat portion of the ring. Both portions were polished under same conditions, and a polishing amount was measured after 60 times and once again measured after 120 times. A result thereof is shown as a graph on a right side of FIG. 7. It was confirmed that the protruding surface portion had a larger polishing amount than the flat portion and polishing proceeds at a faster pace. Moreover, as the polishing amount at this point, a surface roughness which represents a degree of finish of polishing was measured and a difference from an initial value was adopted as a value of the polishing amount. For the measurement, a surface roughness measuring instrument (SURFCOM 2000SD3) manufactured by Tokyo Seimitsu Co., Ltd. was used and a maximum height Rz was measured in conformance with JISB0601-20001. A cutoff value was set to 0.8.

Figure 8:
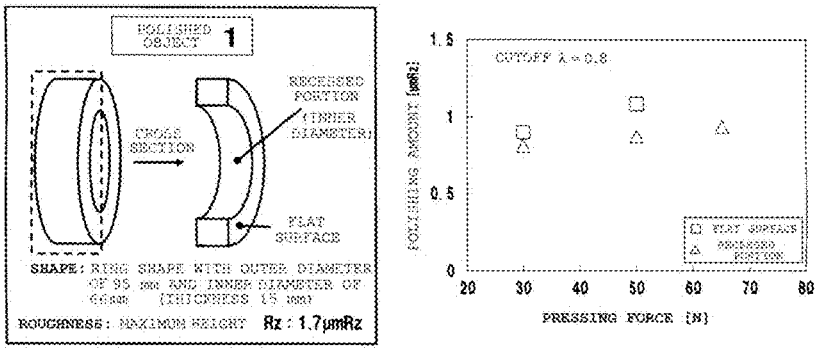
FIG. 8 is an explanatory diagram showing determination of an appropriate pressing force when polishing a second polished object having a recessed portion and a flat portion.

FIG. 8 is an explanatory diagram showing determination of an appropriate pressing force when polishing a second polished object having a recessed portion and a flat portion. Specifications of the second polished object are as shown on a left side of the diagram, in which the second polished object has a ring shape with an outer diameter of 95 mm, an inner diameter of 66 mm, and a thickness of 15 mm and a surface roughness with a maximum height Rz of 1.7 μmRz, and is created by coating a superalloy substrate with a diamond using a hot-filament CVD method. With the second polished object as a test sample, performing a rubbing movement 120 times while switching the pressing force of the polishing member among 30 N, 50 N, and 65 N under similar machining conditions as the first polished object (however, suspending irradiation of a laser beam) revealed that the flat portion had a larger polishing amount. Values thereof are shown as a graph on a right side of FIG. 8. It was confirmed that a state where the flat portion (top surface) is polished by 30 N is approximately comparable to a polishing amount when the recessed portion is polished by 65 N. Therefore, when polishing the second polished object, by applying a pressing force of 30 N to polish the flat portion and a pressing force of 65 N to polish the recessed portion, appropriate polishing can be performed in which non-uniform polishing does not occur.

In this manner, while data of an appropriate pressing force corresponding to individual selection conditions is acquired and accumulated, specifically, a database is created in accordance with combinations of a material and a tip shape of the polishing member and a shape of the polished object. In addition, a plurality of samples are also prepared with respect to diamond crystal sizes, polishing amount data at a same pressing force is acquired and a relationship between a crystal size and a polishing amount is adopted as table data, and multistage table data is compiled by sequentially varying the pressing force to create a database.

Embodiment

Figure 9:
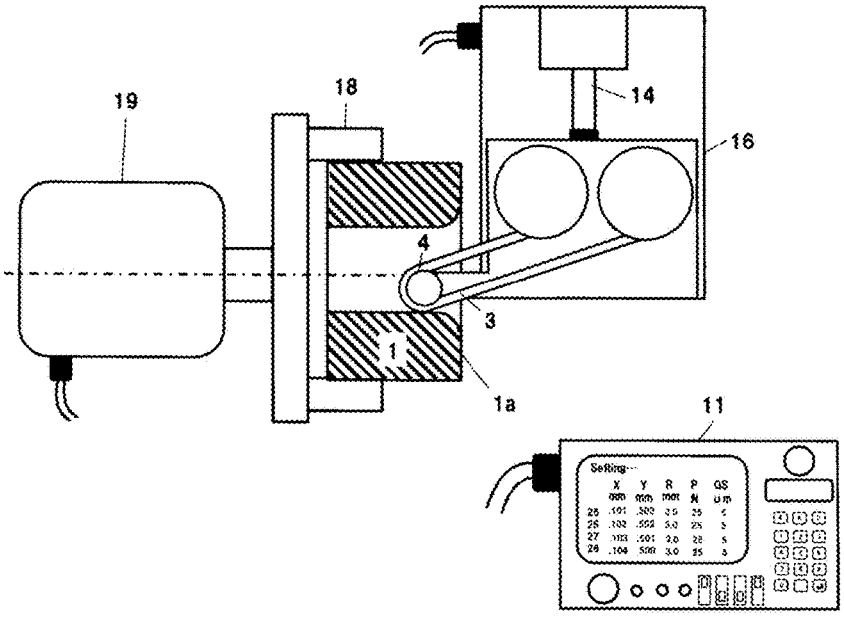
FIG. 9 is a diagram showing a configuration of a machining unit of a polishing apparatus according to the present invention.
Figure 10:
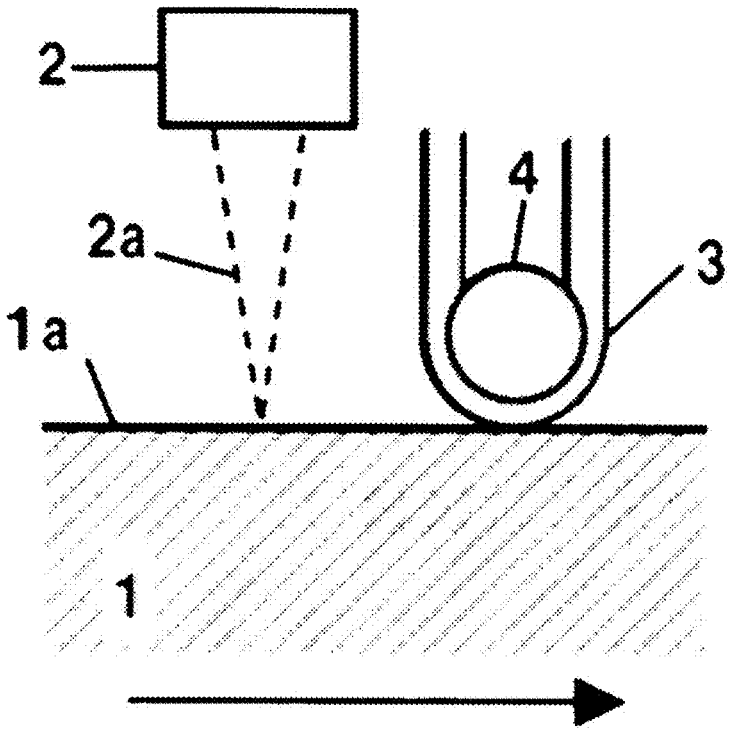
FIG. 10 Related Art
FIG. 10 is a diagram showing the diamond surface polishing method according to Patent Literature 1.

Next, an example of a polishing apparatus for implementing the polishing method according to the present invention will be described. FIG. 9 shows an example of a configuration of a machining unit of the polishing apparatus according to the present invention. A polishing unit is installed on top of the polishing head driving means 16, and positions and attitudes of the polishing unit and the polishing head with respect to the polished object 1 are determined by the driving means.

In addition, a metallic linear member is used as the polishing member 3, a tip of the polishing unit constitutes a polishing head, and the polishing head pressing means 14 which presses the polishing head against a machining surface is also arranged on the polishing head driving means 16.

The polished object is held by polished object holding means 18 and is rotationally driven by a motor 19 so that the polished object rubs against the polishing head. Since an outer circumferential surface of the polished object work has a protruding shape and a top surface is a flat surface, polishing is performed by applying a small pressing force to the outer circumferential surface and a large pressing force to the top surface.

INDUSTRIAL APPLICABILITY

While the polishing member according to the present invention has been described in the present specification as a polishing member which has a metal that is easily reactive with carbon or a carburizing metal on a surface thereof and which performs chemical polishing, the polishing member is not limited thereto and can also be adapted to those of a mechanical polishing system using a diamond abrasive paper, a belt abrasive material, or a diamond wire as long as an elongated polishing member is in a mode where the polishing member is continuously or intermittently paid out and wound up.

The invention claimed is:

1. A diamond surface polishing method for polishing a polished object, the surface of which is made of diamond, the method comprising:

rubbing a polishing member having an elongated shape and containing at least a metal or a metal oxide against the diamond surface, wherein, while a polishing surface of the polishing member is continuously or intermittently paid out, a pressing force of the polishing member is controlled in accordance with at least one of (i) material properties of the polishing member and (ii) a shape of the polished object in a rubbing section, so that contact surface pressure in a machining area becomes uniform, and wherein the pressing force of the polishing member is corrected in accordance with a crystal size of the diamond surface of the polished object.

2. The diamond surface polishing method according to claim 1, wherein the pressing force of the polishing member is increased with increasing crystal size of the diamond surface of the polished object, and decreased with decreasing crystal size of the diamond surface of the polished object.

3. A diamond surface polishing apparatus, comprising:

means for holding a polished object;

a polishing member having an elongated shape and containing at least a metal or a metal oxide;

means for pressing the polishing member toward a machining surface of the polished object; and means for causing the polishing member and the polished object to relatively move and rub against each other, the diamond surface polishing apparatus further comprising:

means for inputting and storing a shape or coordinate information of the polished object;

means for inputting or computing a pressing force of the means for pressing the polishing member in accordance with the shape of the polished object; and means for inputting a crystal size of a diamond, wherein the pressing force is correctively computed in accordance with the crystal size that has been input, wherein while a polishing surface of the polishing member is continuously or intermittently paid out, the means for pressing the polishing member is controlled in accordance with the pressing force that has been input or computed in accordance with the shape of the polished object and that has been correctively computed in accordance with the crystal size.

4. The diamond surface polishing apparatus according to claim 3, wherein the means for inputting or computing a pressing force computes the pressing force so that the contact surface pressure in the machining area becomes uniform.

5. The polishing apparatus according to claim 3, further comprising means for continuously or intermittently paying out the polishing member.

6. The polishing apparatus according to claim 4, further comprising means for continuously or intermittently paying out the polishing member.

7. The polishing apparatus according to claim 3, further comprising means for rotating the means for holding the polished object.

8. The polishing apparatus according to claim 4, further comprising means for rotating the means for holding the polished object.

9. The polishing apparatus according to claim 5, further comprising means for rotating the means for holding the polished object.

10. The polishing apparatus according to claim 6, further comprising means for rotating the means for holding the polished object.

11. The diamond surface polishing apparatus according to claim 3, further comprising:

a storage unit configured to store correspondence information between a correction amount for correcting the pressing force and a crystal size of the diamond; and a control unit configured to read the correspondence information from the storage unit based on the crystal size that has been input, to compute a corrected pressing force based on the correspondence information, and to output the corrected pressing force to the means for pressing the polishing member, wherein the pressing force of the polishing member is increased with increasing crystal size, and decreased with decreasing crystal size.

12. The diamond surface polishing apparatus according to claim 4, further comprising:

a storage unit configured to store correspondence information between a correction amount for correcting the pressing force and a crystal size of the diamond; and a control unit configured to read the correspondence information from the storage unit based on the crystal size that has been input, to compute a corrected pressing force based on the correspondence information, and to output the corrected pressing force to the means for pressing the polishing member, wherein the pressing force of the polishing member is increased with increasing crystal size, and decreased with decreasing crystal size.

13. The diamond surface polishing apparatus according to claim 5, further comprising:

a storage unit configured to store correspondence information between a correction amount for correcting the pressing force and a crystal size of the diamond; and a control unit configured to read the correspondence information from the storage unit based on the crystal size that has been input, to compute a corrected pressing force based on the correspondence information, and to output the corrected pressing force to the means for pressing the polishing member, wherein the pressing force of the polishing member is increased with increasing crystal size, and decreased with decreasing crystal size.

14. The diamond surface polishing apparatus according to claim 6, further comprising:

a storage unit configured to store correspondence information between a correction amount for correcting the pressing force and a crystal size of the diamond; and a control unit configured to read the correspondence information from the storage unit based on the crystal size that has been input, to compute a corrected pressing force based on the correspondence information, and to output the corrected pressing force to the means for pressing the polishing member, wherein the pressing force of the polishing member is increased with increasing crystal size and decreased with decreasing crystal size.

15. The diamond surface polishing apparatus according to claim 7, further comprising:

a storage unit configured to store correspondence information between a correction amount for correcting the pressing force and a crystal size of the diamond; and a control unit configured to read the correspondence information from the storage unit based on the crystal size that has been input, to compute a corrected pressing force based on the correspondence information, and to output the corrected pressing force to the means for pressing the polishing member, wherein the pressing force of the polishing member is increased with increasing crystal size, and decreased with decreasing crystal size.

16. The diamond surface polishing apparatus according to claim 8, further comprising:

a storage unit configured to store correspondence information between a correction amount for correcting the pressing force and a crystal size of the diamond; and a control unit configured to read the correspondence information from the storage unit based on the crystal size that has been input, to compute a corrected pressing force based on the correspondence information, and to output the corrected pressing force to the means for pressing the polishing member, wherein the pressing force of the polishing member is increased with increasing crystal size, and decreased with decreasing crystal size.

17. The diamond surface polishing apparatus according to claim 9, further comprising:

a storage unit configured to store correspondence information between a correction amount for correcting the pressing force and a crystal size of the diamond; and a control unit configured to read the correspondence information from the storage unit based on the crystal size that has been input, to compute a corrected pressing force based on the correspondence information, and to output the corrected pressing force to the means for pressing the polishing member, wherein the pressing force of the polishing member is increased with increasing crystal size, and decreased with decreasing crystal size.

18. The diamond surface polishing method according to claim 1, wherein the polishing member has a linear or a belt-like shape.

19. The diamond surface polishing apparatus according to claim 3, wherein the polishing member has a linear or a belt-like shape.

* * * * *